US006010598A

United States Patent [19]

Boutilier et al.

[11] Patent Number: 6,010,598

[45] Date of Patent: Jan. 4, 2000

[54] PAPERMAKING BELT WITH IMPROVED LIFE

[75] Inventors: Glenn David Boutilier, Cincinnati; Paul Dennis Trokhan, Hamilton; Michael Gomer Stelljes, Jr., West Chester, all of Ohio

[73] Assignee: The Procter & Gamble Company, Cincinnati, Ohio

[21] Appl. No.: 08/853,561

[22] Filed: May 8, 1997

[51] Int. Cl.[7] ..... G03C 5/56

[52] U.S. Cl. ..... 162/348; 162/903; 430/18

[58] Field of Search ..... 430/320, 18; 162/164.6, 162/930, 348

[56] References Cited

U.S. PATENT DOCUMENTS

| | | | |
|---|---|---|---|
| 3,556,791 | 1/1971 | Suzuki et al. | 430/271.1 |
| 4,358,354 | 11/1982 | Iida et al. | 204/159.15 |
| 4,514,345 | 4/1985 | Johnson et al. | 264/22 |
| 4,528,239 | 7/1985 | Trokhan | 442/33 |
| 4,528,345 | 7/1985 | Waddill | 525/523 |
| 4,529,480 | 7/1985 | Trokhan | 162/109 |
| 4,861,629 | 8/1989 | Nahm | 427/355 |
| 5,059,283 | 10/1991 | Hood et al. | 162/199 |
| 5,073,235 | 12/1991 | Trokhan | 162/199 |
| 5,463,110 | 10/1995 | Chen et al. | 560/172 |
| 5,496,624 | 3/1996 | Stelljes, Jr. et al. | 428/229 |
| 5,500,277 | 3/1996 | Trokhan et al. | 428/196 |
| 5,503,715 | 4/1996 | Trokhan et al. | 162/296 |
| 5,514,523 | 5/1996 | Trokhan et al. | 430/320 |
| 5,527,428 | 6/1996 | Trokhan et al. | 162/116 |
| 5,534,326 | 7/1996 | Trokhan et al. | 428/131 |
| 5,554,467 | 9/1996 | Trokhan et al. | 430/11 |
| 5,556,509 | 9/1996 | Trokhan et al. | 162/111 |
| 5,628,876 | 5/1997 | Ayers et al. | 162/358.2 |

*Primary Examiner*—Bernard Codd
*Attorney, Agent, or Firm*—Julie A. Glazer; Larry L. Huston; Edward J. Milbrada

[57] ABSTRACT

A papermaking belt comprised of a resinous polymer with improved elongation. The papermaking belt of this invention is comprised of a reinforcing element and a resinous polymer wherein the resinous polymer exhibits improved elongation both at room temperature and elevated temperatures while maintaining creep resistance and without any undue loss of tensile strength. In addition to papermaking belts, the resinous polymer of this invention may also be used for other applications.

21 Claims, 1 Drawing Sheet

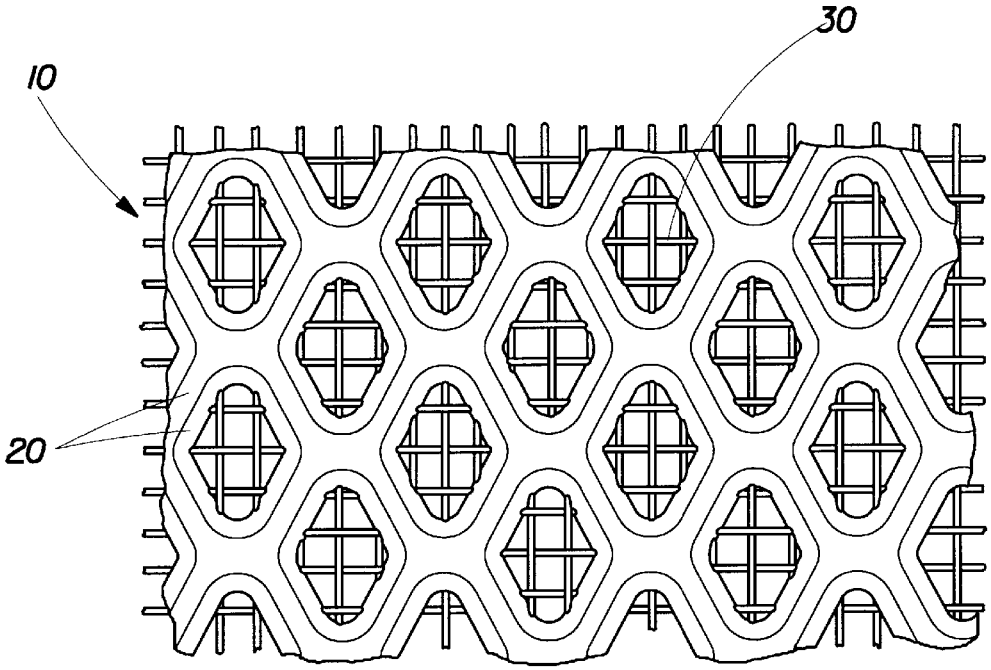
30
10
20

PAPERMAKING BELT WITH IMPROVED LIFE

FIELD OF THE INVENTION

This invention relates to a papermaking belt comprised of a resinous polymer which exhibits improved properties.

BACKGROUND OF THE INVENTION

Papermaking belts, well known in the art, are utilized for producing patterned paper. The paper made by utilizing a papermaking belt of the type disclosed in this invention is described in commonly assigned U.S. Pat. No. 4,528,239 issued to Trokhan on Jul. 9, 1985; U.S. Pat. No. 5,514,523 issued to Trokhan et al. on May 7, 1996; U.S. Pat. No. 5,503,715 issued to Trokhan et al. on Apr. 2, 1996; U.S. Pat. No. 5,334,289 issued to Trokhan et al. on Aug. 2, 1994; U.S. Pat. No. 5,554,467 issued to Trokhan et al. on Sep. 10, 1996; U.S. Pat. No. 4,514,345 issued to Johnson et al. on Apr. 30, 1985; U.S. Pat. No. 5,534,326 issued to Trokhan et al. on Jul. 9, 1996; U.S. Pat. No. 5,556,509 issued to Trokhan et al. on Sep. 17, 1996; and U.S. Pat. No. 5,628,876 issued to Ayers et al. on May. 13, 1997, the disclosures of which are incorporated herein by reference.

Papermaking belts are typically composed of two key components: a reinforcing element; and a resinous polymer as taught by Trokhan '239 and Johnson et al. '345. The resins utilized to make the papermaking belts of these teachings suffer from a common drawback wherein as the resins age during papermaking, embrittlement, cracking and resin loss occur resulting in reduced belt life. It is believed that resin elongation is the key property lost as aging occurs.

The object of this invention is to provide a papermaking belt comprised of a cured resinous polymer exhibiting improved ultimate elongation defined as the elongation at the breaking point. Another object of this invention is to improve papermaking belt life by providing a papermaking belt with improved resin elongation at elevated temperatures without an undue loss of creep resistance, tensile strength and/or hardness at elevated temperature relative to the prior art.

SUMMARY OF THE INVENTION

This invention comprises a papermaking belt wherein the belt is comprised of a resinous polymer. The resinous polymer is disposed in a framework. After curing, the polymer has an elongation at 22° C. of at least about 100% and a tensile strength at room temperature of at least about 2600 psi.

After curing, this same polymer has an elongation of at least about 45% and a tensile strength of at least about 700 psi wherein both the elongation and tensile strength of the polymer are measured at a temperature of 90° C.

The cured resinous polymer after being aged for twenty-four hours at an air temperature of 140° C. in a convection oven has an elongation measured at 22° C. of at least about 70% and tensile strength measured at 22° C. of at least about 2000 psi.

BRIEF DESCRIPTION OF THE DRAWINGS

FIG. 1 Plan view of one completely assembled embodiment of a papermaking belt

DETAILED DESCRIPTION OF THE INVENTION

Referring to FIG. 1, the present invention relates to a papermaking belt 10 comprising a resinous polymer 20 disposed within a framework. The resinous polymer 20 after curing exhibits improved elongation without sacrificing hardness or creep resistance. Most preferably the resinous polymer 20 of this invention is completely cured. A resinous polymer 20 is considered completely cured at the point where no additional heat from polymerization is evolved upon continuing irradiation of the sample. As would be well-known to one skilled in the art, a calorimeter can be used to make this measurement. It should be noted that even at complete cure as described above, polymerizable groups may be trapped within the polymeric network and hence inaccessible to further polymerization.

The papermaking belts 10 of this invention may be made according to commonly assigned U.S. Pat. Nos. 5,334,289 issued to Trokhan et al. on Aug. 2, 1994; U.S. Pat. No. 4,514,345 issued to Johnson et al. on Apr. 30, 1985; 5,527,428 issued to Trokhan et al. on Jun. 18, 1996 and 4,529,480 issued to Trokhan on Jul. 16, 1985 the disclosures of which are incorporated by reference for the purpose of showing how to make papermaking belts 10 for use with the present invention. In the preferred method for producing a papermaking belt 10, the four key materials required include: a reinforcing element 30 such as a woven screen; a barrier film such as a thermoplastic sheet; a mask comprising a framework of transparent and opaque regions wherein the opaque regions define a preselected pattern of gross foramina in the framework; and a liquid photosensitive resin which is cured during the beltmaking process in order to form a resinous polymer 20.

The reinforcing element 30 may be made according to commonly assigned U.S. Pat. Nos. 5,500,277, issued Mar. 19, 1996, to Trokhan et al. or 5,496,624, issued Mar. 5, 1996, to Stelljes Jr. et al., which patents are incorporated herein by reference. Examples of suitable reinforcing elements 30 include paper machine clothing such as forming fabrics, wet press felts and dryer fabrics. Alternatively, a Jacquard weave reinforcing element 30 may be utilized for the papermaking belt 10 having a framework made of the resinous polymer 20 according to the present invention.

A method of producing a papermaking belt 10 includes applying barrier film to the working surface of the belt 10 forming unit; juxtaposing a reinforcing element 30 to the barrier film so that the barrier film is interposed between the reinforcing element 30 and the forming unit; applying a coating of liquid photosensitive resin to the surfaces of the reinforcing element 30; controlling the thickness of the coating to a preselected value; juxtaposing in contacting relationship with the coating of liquid photosensitive resin a mask comprising a framework of both opaque and transparent regions; exposing the liquid photosensitive resin to light having an activating wavelength through the mask thereby inducing curing of the liquid photosensitive resin in those regions which are in register with the transparent regions of the mask; and removing from the reinforcing element 30 substantially all of the uncured liquid photosensitive resin. The exact apparatus or equipment used in the practice of the present invention is immaterial so long as it can, in fact, be used to practice the present invention.

Properties of the resinous polymer 20 which are deemed to be important to papermaking belt 10 life include elongation, tensile strength, hardness and creep resistance at both room temperatures and elevated temperatures. In order to maximize the life of the papermaking belt 10 it is especially desirable for the resinous polymer 20 at elevated temperatures, including those temperatures to which the belt 10 is exposed during use, to exhibit elongation without unduly sacrificing creep resistance, tensile strength, or hardness relative to the prior art. The resinous polymer 20 of this invention has a room temperature elongation measured at 22° C. of at least about 100%, more preferred of about 110% and even more preferred of 125%. The resinous polymer 20 of this invention exhibits improved ultimate elongation while resisting creep and without undue loss of tensile strength and hardness relative to the prior art.

The preferred liquid photosensitive resin composition of this invention is comprised of four key components: a prepolymer; monomers; photoinitiator and antioxidants. A preferred liquid photosensitive resin is Merigraph L-055 available from MacDermid Imaging Technology, Inc. of Wilmington, Del.

The antioxidant component of the liquid photosensitive resinous polymer may be carried out according to commonly assigned U.S. Pat. Nos. 5,059,283 issued to Hood et al. on Oct. 22, 1991 and 5,0573,235 issued to Trokhan on Dec. 17, 1991, both of which are incorporated herein by reference. Antioxidants are added to the liquid photosensitive resin formulation in order to prevent the resinous polymer 20 from oxidizing and causing degradation of the papermaking belt 10 resulting in premature belt 10 failure. Suitable chemicals which may be used as antioxidants include but are not limited to: high molecular weight hindered phenols, secondary amines, phosphates, phosphites, thioesters, sulfur-containing compounds and secondary sulfides. Preferred antioxidants used in the present invention include: Irganox 1010 marketed by Ciba Geigy Corp. of Hawthorne, N.Y. and Cyanox 1790 marketed by Cytec Industries Inc. of West Paterson, N.J. Antioxidants are preferably added in a concentration of from about 0.001% to 5.0% by weight.

The type of papermaking belts 10 described in this invention may be used in conjunction with a variety of different types of paper machines systems and configurations well known in the art including but not limited to fourdrinier forming sections, twin wire formers, crescent formers, through air drying systems and conventional press sections.

Properties of the resinous polymer 20 including tensile strength, elongation, hardness and creep resistance are measured on cured resinous polymer 20 coupon samples. The resinous polymer 20 coupons are prepared by casting a 0.040 inch layer of liquid photosensitive resin over a 1 mil thick polypropylene film and covering it with a 0.004 inch thick polyester film, on a Merigraph 2228 photopolymer exposure unit available from MacDermid Imaging Technology of Wilmington, Del. The sample is first exposed for 30 seconds to the upper lamps and then exposed for 400 seconds to the lower lamps. Both films are removed after curing.

For purposes of tensile testing and elongation, resinous polymer 20 coupons are tested according to ASTM test method D-638. Each coupon is die cut by using a standard type IV dumbell die. The resinous polymer 20 coupon is cut by striking the die with a hammer. The coupon is cut so as to have an overall length of 4.5 inches, a width at the narrowest section of the coupon of 0.25 inches and an overall width of 0.75 inches. A suitable die is available from Testing Machines Inc. of Amityville, N.Y.

For measuring tensile strength and elongation, a resinous polymer 20 coupon is inserted in a tensile tester such as an Instron tensile tester model No. 1122 made by the Instron Corporation of Canton, Mass. A cross-head separation speed of 2 inches per minute and a gauge length of 2.5 inches are selected. The sample is loaded into the tensile tester and tested to breakage by straining the coupon sample until it reaches its breaking point. The elongation at the point of breakage, defined as the ultimate elongation, is measured directly from the tensile tester or, alternatively may be measured using a chart recorder as is well known in the art.

Hardness of the resinous polymer 20 coupons is measured according to ASTM test method D-2240 using a Shore D durometer gauge and a leverloader stand available from the Shore Instrument and Manufacturing Company of Freeport, N.Y. Resinous polymer 20 coupons used for hardness testing are cut with a circular die of 1 inch in diameter. The circular coupons are stacked to achieve a total sample thickness of at least 0.250 inches prior to testing.

The properties of the present invention and the prior art measured at 22° C. are set forth in Table I below.

TABLE I

| Prior Art Resin ultimate Elong. (%) measured | Present Invention Resin ultimate Elong. (%) measured | Prior Art Resin Tensile Strength (psi) measured | Present Invention Resin Tensile Strength (psi) measured | Prior Art Resin Hardness (Shore D) measured | Present Invention Resin Hardness (Shore D) measured |
|---|---|---|---|---|---|
| at 22° C. 76.2 | at 22° C. 125 | at 22° C. 3906 | at 22° C. 3980 | at 22° C. 48 | at 22° C. 45 |

Resinous polymer 20 properties including tensile strength, elongation, creep and Shore D hardness are also measured at elevated temperatures. Tensile strength and elongation are measured at 90° C. on an Instron Tensile Tester in which the crosshead grips of the Instron are enclosed in an environmental test chamber heated to 90° C. ±1° C. Suitable environmental test chambers are available from Instron Corp. of Canton, Mass. The resinous polymer 20 coupon to be tested is also placed in the test chamber for three minutes and then immediately tested on the Instron.

For hardness measurements done at 90° C., the leverloader stand and resinous polymer 20 coupon samples are preheated to 90° C. in a forced draft laboratory oven for 30 minutes and then tested in the oven according to the procedure described above.

Creep resistance is measured using a Bohlin CVO Controlled Stress rheometer manufactured by Bohlin Corporation of Cranbury, N.J. For creep testing at 90° C., the resinous polymer 20 coupon samples are heated to 90° C. for ten minutes in the rheometer and then tested. Creep measurements are taken at 25% strain and 100 seconds after the initial load has been applied. The resinous polymer 20 of this invention at 90° C. and 25% strain will exhibit a creep modulus of greater than about $2\times10^7$ dynes/cm$^2$ wherein the modulus decreases less than 10% in the initial 100 seconds after the stress has been applied. The properties of the resinous polymer 20 tested at 90° C. according to the present invention and the prior art are set forth in Table II below.

TABLE II

| Prior Art Resin Ultimate Elong. (%) measured at 90° C. | Present Invention Resin Ultimate Elong. (%) measured at 90° C. | Prior Art Resin Tensile Strength (psi) measured at 90° C. | Present Invention Resin Tensile Strength (psi) measured at 90° C. | Prior Art Resin Hardness (Shore D) measured at 90° C. | Present Invention Resin Hardness (Shore D) measured at 90° C. | Prior Art Resin Creep Modulus (dynes/cm$^2$) measured at: 25% strain, 100 seconds after initial load applied at temp. of 90° C. | Present Invention Resin Creep Modulus (dynes/cm$^2$) measured at: 25% strain, 100 seconds after initial load applied at temp. of 90° C. |
|---|---|---|---|---|---|---|---|
| 36 | 60 | 1161 | 980 | 29 | 27 | $2.6 \times 10^7$ | $2.7 \times 10^7$ |

In accordance with another important property of the present invention a resinous polymer 20 coupon made according to the procedure described above is aged for twenty-four hours in a convection oven at a temperature of 140±2° C. The coupon is removed after twenty-four hours and tested as soon as reasonably practical as described above after allowing the coupon to cool to 22° C. This same test is repeated on a coupon aged for ninety-six hours. The properties of the resinous polymer 20 aged at elevated temperatures according to the present invention and the prior art are set forth in Table III below.

TABLE III

| Hrs. Sample is Maint. at 140° C. | Prior Art Resin Elong. (%) | Pres. Inv. Resin Elong. (%) | Prior Art Tensile Strength (psi) | Present Invention Tensile Strength (psi) |
|---|---|---|---|---|
| 24 | 62.5 | 89.0 | 2929 | 2600 |
| 96 | 44.3 | 80.0 | 1808 | 2100 |

Tables II and III show that contrary to conventional wisdom, tensile strength is not the determinative property for improving belt 10 life. It is to be recognized that the above described resin can be used for other applications as well as the papermaking belts described herein. While particular embodiments of the present invention have been illustrated and described, it would be obvious to those skilled in the art that various other changes and modifications can be made without departing from the scope and spirit of the invention. It is therefore intended to cover in the appended claims all such changes and modifications that are within the scope of this invention.

What is claimed is:

1. A papermaking belt comprising a patterned resinous polymer, wherein said resinous polymer after curing has an elongation of at least about 100% and a tensile strength of at least about 2600 pounds per square inch whereby said elongation and tensile are measured at a temperature of 22 degrees Celsius.

2. A papermaking belt comprising a patterned resinous polymers, wherein said resinous polymer after curing has an elongation of at least about 45% and a tensile strength of at least about 700 pounds per square inch whereby said elongation and tensile are measured at a temperature of 90 degrees Celsius.

3. A papermaking belt comprising a patterned resinous polymers, wherein said resinous polymer after curing is aged for 24 hours at a temperature of about 140 degrees Celsius has an elongation of at least about 70% and a tensile strength of at least about 2000 pounds per square inch whereby said elongation and tensile are measured at a temperature of 22 degrees Celsius.

4. A papermaking belt according to claim 3 wherein said resinous polymer has an elongation of at least about 125%.

5. A papermaking belt according to claim 1 wherein said resinous polymer has an elongation of at least about 110% and a tensile strength of at least about 3000 pounds per square inch.

6. A papermaking belt according to claim 5 wherein said resinous polymer has an elongation of at least about 125% and a tensile strength of at least about 3000 pounds per square inch.

7. A papermaking belt according to claim 6 wherein said resinous polymer has a tensile strength of about 3500 pounds per square inch.

8. A papermaking belt according to claim 6 wherein said resinous polymer has a Shore D hardness of about at least 44.

9. A papermaking belt according to claim 1 wherein said resinous polymer has a Shore D hardness of about at least 40.

10. A papermaking belt according to claim 1 wherein said resinous polymer has a tensile strength of at least about 3000 pounds per square inch.

11. A papermaking belt according to claim 10 wherein said resinous polymer has a tensile strength of at least about 900 pounds per square inch.

12. A papermaking belt according to claim 10 wherein said resinous polymer has an elongation of at least about 50%.

13. A papermaking belt according to claim 10 wherein said resinous polymer has an elongation of at least about 55% and a tensile strength of at least about 900 pounds per square inch.

14. A papermaking belt according to claim 10 wherein said resinous polymer has a creep modulus of greater than about $2 \times 10^7$ dynes per square centimeter at 25% strain wherein said modulus decreases less than 10% in the initial 100 seconds the load is applied.

15. A papermaking belt according to claim 14 wherein said resinous polymer has a Shore D hardness of at least about 24.

16. A papermaking belt according to claim 10 Wherein said resinous polymer has a Shore D hardness of about at least 20.

17. A papermaking belt according to claim 1 wherein said resinous polymer has an elongation of at least about 110%.

18. A papermaking belt according to claim 17 wherein said resinous polymer has a tensile strength of at least about 2500 pounds per square inch.

19. A papermaking belt according to claim 17 wherein said resinous polymer has an elongation of at least about 80%.

20. A papermaking belt according to claim 19 wherein said resinous polymer has an elongation of at least about 85%.

21. A papermaking belt according to claim 17 wherein said resinous polymer has an elongation of at least about 80% and a tensile strength of at least about 2500 pounds per square inch.

* * * * *

UNITED STATES PATENT AND TRADEMARK OFFICE

CERTIFICATE OF CORRECTION

PATENT NO. : 6,010,598
DATED : January 4, 2000
INVENTOR(S) : Glenn David Boutilier et al.

It is certified that error appears in the above-identified patent and that said Letters Patent is hereby corrected as shown below:

Column 6,
Line 21, Claim 4 should be renumbered as Claim 8, and please delete "3" after claim and insert therefore -- 7 --.
Line 23, Claim 5 should be renumbered as Claim 12.
Line 27, Claim 6 should be renumbered as Claim 13, and please delete "5" after claim and insert therefore -- 12 --.
Line 31, Claim 7 should be renumbered as Claim 14, and please delete "6" after claim and insert therefore -- 13 --.
Line 34, Claim 8 should be renumbered as Claim 21, please delete "6" after claim and insert therefore -- 13 --.
Line 37, Claim 9 should be renumbered as Claim 19.
Line 39, Claim 10 should be renumbered as Claim 4.
Line 42, Claim 11 should be renumbered as Claim 5, and please delete "10" after claim and insert therefore -- 2 --.
Line 45, Claim 12 should be renumberd as Claim 9, and please delete "10" after claim and insert therefore -- 2 --.
Line 48, Claim 13 should be renumbered as Claim 15, and please delete "10" after claim and insert therefore -- 2 --.
Line 52, Claim 14 should be renumbered as Claim 17, and please delete "10" after claim and insert therefore -- 2 --.
Line 57, Claim 15 should be renumbered as Claim 18, and please delete "14" after claim and insert therefore -- 17 --.
Line 60, Claim 16 should be renumbered as Claim 20, and please delete "10" after claim and insert therefore -- 2 --.
Line 63, Claim 17 should be renumbered as Claim 7.
Line 65, Claim 18 should be renumbered as Claim 6, and please delete "17" after claim and insert therefore -- 3 --.

UNITED STATES PATENT AND TRADEMARK OFFICE

CERTIFICATE OF CORRECTION

PATENT NO. : 6,010,598
DATED : January 4, 2000
INVENTOR(S) : Glenn David Boutilier et al.

It is certified that error appears in the above-identified patent and that said Letters Patent is hereby corrected as shown below:

Column 7,
Line 1, Claim 19 should be renumbered as Claim 10, and please delete "17" after claim and insert therefore -- 3 --.
Line 4, Claim 20 should be renumbered as Claim 11, and please delete "19" after claim and insert therefore -- 10 --.

Column 8,
Line 1, Claim 21 should be renumbered as Claim 16, and please delete "17" after claim and insert therefore -- 3 --.

Signed and Sealed this

Twelfth Day of February, 2002

*Attest:*

*Attesting Officer*

JAMES E. ROGAN
*Director of the United States Patent and Trademark Office*